United States Patent [19]

Urheim

[11] Patent Number: 4,958,736

[45] Date of Patent: Sep. 25, 1990

[54] PACKAGE FOR ORAL CONTRACEPTIVE TABLET

[75] Inventor: John E. Urheim, Lincolnshire, Ill.

[73] Assignee: Gynex, Inc., Deerfield, Ill.

[21] Appl. No.: 840,774

[22] Filed: Mar. 18, 1986

[51] Int. Cl.[5] ..... B65D 83/04

[52] U.S. Cl. ..... 206/531; 206/534; 206/538

[58] Field of Search ..... 206/531, 532, 534, 538; 514/170, 171, 843, 178

[56] References Cited

U.S. PATENT DOCUMENTS

| | | | |
|---|---|---|---|
| 3,054,503 | 9/1962 | Hartman, Jr. et al. | 206/531 |
| 3,057,473 | 10/1962 | Stern et al. | 206/534 X |
| 3,126,129 | 3/1964 | Weinberg | 206/534 X |
| 3,278,010 | 10/1966 | Katz | 206/534 |
| 3,942,641 | 3/1976 | Segre | 206/534 |
| 3,957,982 | 5/1976 | Lacknit-Fixson et al. | 514/170 |
| 4,340,141 | 7/1982 | Fischer | 206/531 |
| 4,390,531 | 6/1983 | Edgren | 514/178 X |
| 4,530,839 | 7/1985 | Pasquale | 514/171 |

FOREIGN PATENT DOCUMENTS

| | | | |
|---|---|---|---|
| 2515033 | 4/1983 | France | 206/438 |

OTHER PUBLICATIONS

V. Cullimore, et al., Journal of Molecular and Applied Genetics vol. 2, No. 6, pp. 589–599 (1984).

Gunter Donn, et al., Journal of Molecular and Applied Genetics vol. 2, No. 6, pp. 621–635 (1984).

Pablo A. Scolnik, et al., Journal of Bacteriology vol. 155, pp. 180–185 (1983).

Richard Fisher, et al., Proc. Natl. Acad. Sci. USA, vol. 78, No. 6, pp. 3393–3397 (1981).

*Primary Examiner*—Bryon P. Gehman

*Attorney, Agent, or Firm*—Baker & McKenzie

[57] ABSTRACT

The present invention contemplates a package for oral contraceptive tablets. The package contains four rows of seven tablets per row. Three adjacent rows contain active contraceptive tablets, while the fourth row contains placebo tablets. A line of severability is provided between the row of placebo tablets and an adjacent row of active tablets, thereby enabling dispensing 21-day and 28-day oral contraceptive formulations using a single package.

8 Claims, 1 Drawing Sheet

PACKAGE FOR ORAL CONTRACEPTIVE TABLET

TECHNICAL FIELD

This invention relates to packages for oral contraceptive tablets.

BACKGROUND OF THE INVENTION

Conventional oral contraceptives are administered on a repeating 28 day cycle. Contraceptive tablet taking generally begins on the fifth day of the menstrual cycle or on the first Sunday after menstruation begins, continues for a total of 21 days and begins again after seven days without contraceptive tablets. The patient thereafter takes a tablet each day for three weeks, takes no contraceptives for one week, and begins another 28 day cycle of three weeks of tablet taking and one week without tablets for the desired duration of contraceptive treatment.

Some physicians prefer to prescribe 21 tablet packages and have the patient go without tablets for seven days each cycle. Other physicians prefer 28 tablet packages containing seven placebo tablets to facilitate proper tablet administration.

The result is that most conventional oral contraceptives are provided in both 21 tablet and 28 tablet dispensers. Each package contains 21 contraceptive tablets. The 28 tablet package additionally contains seven placebo tablets. Thus, retail pharmacies necessarily must carry both package types of each oral contraceptive stocked, thereby increasing inventory costs.

It would be advantageous to eliminate the need for two types of packages for each oral contraceptive.

SUMMARY OF THE INVENTION

The present invention contemplates a package for sequential daily oral administration of pharmacologically active contraceptive tablets comprising a carrier sheet provided with 28 compartments arranged in four substantially parallel rows of seven substantially parallel columns. Three adjacent rows have an active tablet in each compartment. A fourth row has a placebo tablet in each compartment. A line of severability is provided between the row of placebo tablets and an adjacent row of active tablets to enhance removal of the row of placebo tablets from the remainder of the package.

The present invention allows pharmacists to fill a physician's prescription for either 21 or 28 packages using a single package. When a 21 tablet package is required, the pharmacist simply tears off the row of placebo tablets along the line of severability. The pharmacy therefore needs to stock only one package type to fill either prescription, thereby reducing its inventory. Further, the drug manufacturer needs only produce one type of package, thereby lowering costs, minimizing inventory, and decreasing the investment in inventory for manufacturers, the wholesalers, and chains and individual pharmacies.

DETAILED DESCRIPTION OF PREFERRED EMBODIMENTS

Figure 1:
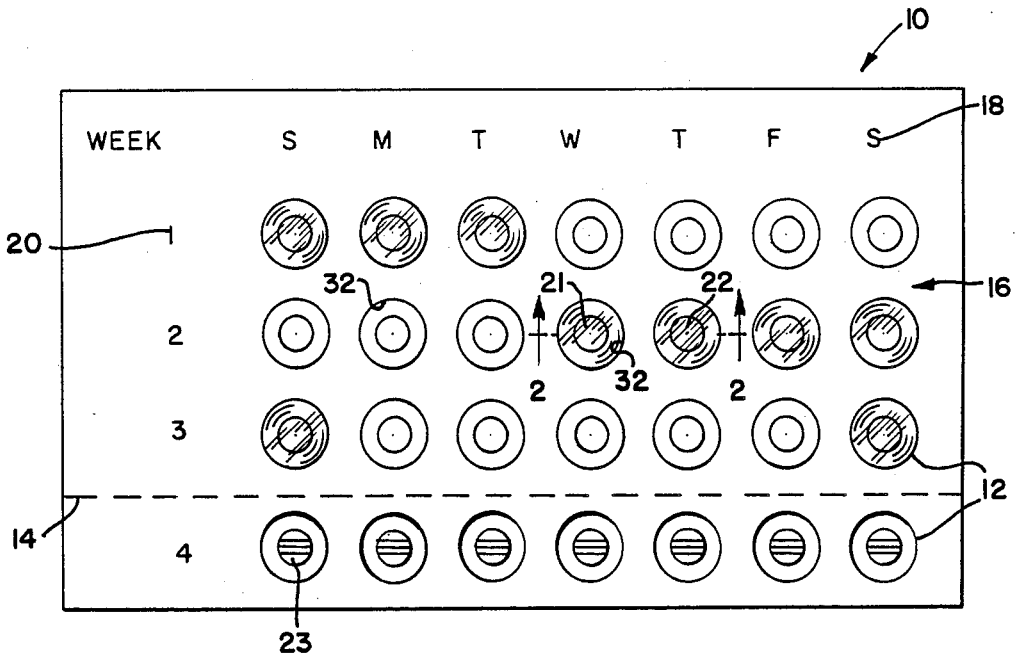
FIG. 1 is a plan view of a package embodying the present invention.

A preferred embodiment of the present invention contemplates a package for sequential daily administration of pharmacologically active oral contraceptive tablets. This invention simplifies manufacturing and stocking oral contraceptive formulations prescribed in both 21 and 28 day packages. A single package containing 28 tablets is provided with a line of severability between 21 active tablets and seven placebo tablets. The package is dispensed as manufactured to fill 28 tablet prescriptions. A row of seven placebo tablets is removed from the package along the line of severability to fill 21 tablet prescriptions.

The present invention is illustrated in FIG. 1. In particular, package 10 is provided with plural compartments 12 arranged in rows and columns. For convenience, and to provide a medication regimen for a lunar month, compartments 12 are arranged in four generally parallel rows and seven generally parallel columns. Each compartment 12 contains a daily dosage of therapeutic medication or placebo to be administered.

An apertured panel 16 is provided with daily indicia 18 and weekly indicia 20. As can be seen in FIG. 1, seven compartments 12 are arranged to form a row containing a week's supply of tablets such as tablets 21 and 22. Tablets 21 and 22 contain a pharmacologically active contraceptive tablet. Tablets 23 are placebo. If desired, placebo tablets 23 can have a coloring different from that of tablets 21 that contain active ingredients. The tablets for each day of the week for the four weeks of the lunar cycle form columns.

This arrangement of compartments resembles a calendar and provides a relatively reliable system with a built-in feedback mechanism in that the patient can readily determine if she has taken the proper tablets on proper days by comparing the calendar date with the appropriate indicia on the package. The patient can easily recognize that a day's dosage has been missed, or if more than one dose has been inadvertently taken on a particular day.

Package 10 is provided with line of severability 14 that traverses package 10 in the longitudinal direction. Line of severability 14 is situated between the third and fourth rows of package 10 and is generally parallel to the rows. In a more preferred embodiment, line of severability 14 is a line of weakening, thereby facilitating severing the last row of tablets along the line; however, the line of severability can also be a crease, a fold line, or the like. The line of weakening can be provided by a line of partial cuts or by a line of perforation.

Figure 2:
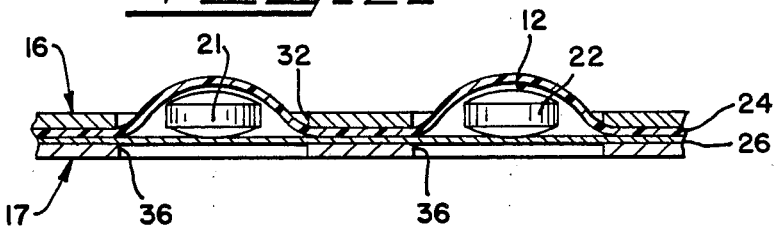
FIG. 2 is an enlarged, partial cross-sectional view taken along plane 2—2 in FIG. 1.

The construction of package 10 can be best seen by reference to FIG. 2. Carrier sheet 24, preferably made of a transparent material, defines each compartment 12. A tablet, such as tablet 22, is received in each compartment 12 and is retained therein by cover 26 that seals compartment 12 from ambient surroundings. If the carrier sheet material is of a sufficiently heavy gauge, no further support is necessary. If a relatively lighter gauge material is desired, one or two apertured panels of a relatively stiff material such as cardboard as illustrated by apertured panels 16 and 17 are provided to sandwich carrier sheet 24 and its associated cover or covers 26 therebetween so as to enhance the overall rigidity of package 10.

Panel 16 defines plural apertures 32 through which extend flexible protrusions or indentations in carrier sheet 24 that define compartments 12. Corresponding apertures 36 are provided in panel 17 and define openings through which the tablets such as tablets 21 and 22 in compartments 12 can be dispensed as cover 26 is ruptured, by flexing or deforming indentations 11 for example. Apertures 32 and apertures 36 are in substantially registry with respect to one another.

Weekly indicia such as 20 can be provided at each row. Daily indicia such as 18 are provided near the top of each column. Oral contraceptive formulations are designed to be taken beginning on predetermined day of the week; most formulations correlate the first day of tablet taking with the fifth day of a woman's menstrual cycle even in "Sunday start" formulations.

Numerous ways to facilitate indicating the day of each tablet are known in the art. For example, U.S. Pat. No. 3,397,671 provides a holder having two rows with 16 daily indicia per row into which a 10 tablet carrier is inserted. The holder is placed over the carrier so that the daily indicia labelling the tablets are appropriate for a particular woman taking the tablets.

As another example, U.S. Pat. No. 3,494,322 discloses a package having four rows of seven compartments. A separate strip with 13 daily indicia can be pulled through a support card that has holes cut out above each column of labels through which the daily indicia can be viewed. The patient aligns the strip as required to expose only the needed indicia.

Other similar embodiments can be used. For example, an adhesive strip with daily indicia can be applied by the patient or an easily labelled surface can be placed atop each column for the patient to mark.

The foregoing description and the drawings are intended as illustrative and are not to be taken as limiting. Other variations and rearrangements of component parts are possible without departing from the spirit and scope of this invention.

I claim:

1. An integral package for sequential daily oral administration of pharmacologically active contraceptive tablets comprising:

a carrier sheet provided with an array of 28 compartments arranged in four substantially parallel rows of seven substantially parallel columns, three adjacent rows having an active tablet in each of said compartments, a fourth row having a placebo tablet in each compartment, a pressure rupturable cover over each of said compartments, and a single line of severability in said sheet, said line being situated between and substantially parallel to said row of placebo tablet containing compartments and an adjacent row of active tablets, said carrier sheet defining, on each side of said line, an integral region free of any other lines of severability between said compartments, whereby said fourth row of placebo tablet containing compartments can be readily separated from said three rows of active tablet containing compartments.

2. The package in accordance with claim 1 wherein said carrier sheet and said cover are sandwiched between a pair of apertured panels, each said compartment being received within an aperture of one of said panels, adjacent apertures being in substantial registry with one another, and a line of severability in the panels substantially corresponding to said line of severability between said rows of compartments.

3. The package in accordance with claim 2 having daily indicia at each of said columns along a row of active tablets.

4. The package in accordance with claim 2 wherein said carrier sheet is transparent, said cover material is tin foil and said panel material is cardboard.

5. The package in accordance with claim 1 wherein said line of severability is a line of weakening.

6. The package in accordance with claim 5 wherein said line of weakening is provided by a line of partial cuts in said package.

7. The package in accordance with claim 5 wherein said line of weakening is provided by a line of perforations in said package.

8. An integral package for sequential claim daily administration of pharmacologically active contraceptive tablets comprising:

a sheet of transparent carrier material provided with an array of 28 compartments, said compartments arranged in four substantially parallel rows of seven substantially parallel columns; a cover of tin foil over each said compartment; said carrier sheet and said cover sandwiched between a pair of apertured cardboard panels, each said compartment being received within an aperture of one of said panels and adjacent apertures being in substantial registry with one another; three adjacent rows containing an active tablet in each compartment; a fourth row containing a placebo tablet in each compartment; daily indicia provided over each compartment of at least one row of active tablets; and a single line of weakening provided in the package between and substantially parallel to said row of placebo tablets and an adjacent row of active tablets, said cardboard panels, carrier sheet, and said cover each defining, on each side of said line, an integral region free of any other lines of weakening between said compartments, whereby said fourth row of placebo tablet containing compartments can be readily separated from said three rows of active tablet containing compartments.

* * * * *